US006777065B2

(12) United States Patent
Grynaeus et al.

(10) Patent No.: US 6,777,065 B2
(45) Date of Patent: Aug. 17, 2004

(54) FIXING LINER WITH DOUBLE LAYER ADHESIVE DOTS

(75) Inventors: Peter Grynaeus, Birkenau (DE); Michael Kalbe, Limburg (DE)

(73) Assignee: Firma Carl Freudenberg, Weinhem (DE)

( * ) Notice: Subject to any disclaimer, the term of this patent is extended or adjusted under 35 U.S.C. 154(b) by 116 days.

(21) Appl. No.: 09/878,028

(22) Filed: Jun. 8, 2001

(65) Prior Publication Data

US 2002/0019185 A1 Feb. 14, 2002

(30) Foreign Application Priority Data

Jun. 8, 2000 (DE) ..... 100 27 957

(51) Int. Cl.[7] ..... B32B 27/04; B32B 3/02; B32B 7/14

(52) U.S. Cl. ..... 428/196; 428/195; 428/200; 428/343; 428/346; 428/354; 428/355 EP; 428/353; 442/149; 442/150

(58) Field of Search ..... 535/453; 525/131; 428/195, 196, 200, 343, 346, 354, 353, 355 EP, 361, 364, 365, 368, 375, 378; 442/149, 150, 151, 374; 523/453

(56) References Cited

U.S. PATENT DOCUMENTS 5,677,038 A 10/1997 Simon et al.
5,902,843 A * 5/1999 Simon et al. ..... 523/453
6,300,413 B1 * 10/2001 Simon et al. ..... 525/131

FOREIGN PATENT DOCUMENTS

| | | |
|---|---|---|
| DE | 2 214 236 | 10/1973 |
| DE | 2 231 723 | 1/1974 |
| DE | 25 36 911 | 2/1977 |
| DE | 32 30 579 | 2/1984 |
| EP | 0 940 461 | 9/1999 |

* cited by examiner

*Primary Examiner*—Arti R. Singh
(74) *Attorney, Agent, or Firm*—Kenyon & Kenyon

(57) ABSTRACT

A fixing liner, made up of a textile liner web (1), which is coated on one side with double-layer adhesive mass points, which are made up of lower points, facing the liner web, and upper points (2, 3); arranged on top of them, the lower points (2) being made up of a powdery mixture of 25 to 90% by weight of an epoxide resin having an epoxide equivalent weight of 500 to 4000 mVal/kg, 10 to 75% by weight of an acid terminated polyamide, a polyester, a polyurethane and/or a vinyl copolymer having carboxyl, anhydro, hydroxy, and/or amido side groups and having a melt flow index (MFI) of 40 to 120 g/10 min measured at 160° C. and 2.16 kg, and 0 to 20% by weight of a hardener as well as the auxiliary and filler materials that are customarily used to produce a paste, the upper points (3) being composed of acid-terminated polyamides and/or copolyesters, and the weight ratio of the masses, obtained in the lower and upper points (2, 3), being 1:0.5 to 1:5.

4 Claims, 1 Drawing Sheet

FIXING LINER WITH DOUBLE LAYER ADHESIVE DOTS

FIELD OF THE INVENTION

The present invention relates to a fixing liner, composed of a textile liner web, which is coated on one side with double-layer adhesive mass points, which are made up of lower points, facing the liner web, and upper points, arranged above them.

BACKGROUND OF THE INVENTION

From the document, European Patent A 0 940 461, a cross-linkable hot-melt adhesive mass is known for coating and/or laminating textile fabrics, in which a cross-linking component is bound in a polyolefin matrix, and the reactive components only react in the melted mass under conditions of cross-linking. As cross-linking components, isocyanates or epoxides having molar masses between 2000 and 6000 grams per mol are indicated. The actual hot-melt adhesive mass, in this context, is composed of amino-terminated co-polyamides or copolyesters, which are used both in the lower and in the upper points. Disadvantageous in this solution is the fact that, for one thing, the cross-linking components must first be bound in a polyolefin matrix, which protects against humidity—an expensive process—, and that the amino-terminated co-polyamides have a strong tendency to yellow.

Furthermore, from the document, U.S. Pat. No. 5,677,038, a double-layer hot-melt adhesive mass is known, whose lower point is made up of a co-polyamide or copolyester, applied in paste form, and whose upper point is made up of a mixture of 0 to 25% by weight of a co-polyamide, 50 to 95% by weight of a copolyester, and 5 to 25% by weight of an epoxide. As separation forces for the textile materials bonded using this hot-melt adhesive system, values under 10 N/5 cm are indicated, which are further reduced after a washing. In addition to the cited documents, other double-layer adhesive masses are known from the documents, German Patent A 22 14 236, German Patent A 22 31 723, German Patent A 25 36 911, and German Patent A 32 30 579. By using relatively light nonwoven fabrics, i.e., those having a small mass per unit area, it is indeed possible to obtain very soft laminates, but nonwoven fabrics have the disadvantage that they are sensitive with regard to the reverse attaching of the hot-melt adhesive masses. In this context, reverse attaching is understood to mean an undesirable adhesion between two liner materials, which can occur when the liner web coated with the adhesive point mass, hereinafter termed the fixing liner, is bonded to the upper material in the inner-sandwich fixing method. In this context, the inner sandwich is composed of the layer sequence, upper material, coated liner web, and coated liner web, upper material, i.e., so that the uncoated sides of the liner webs contact one another. It is true that the quantity of coating which was applied per square meter of liner web was reduced from 18–25 g/m$^2$ to 7–15 g/m$^2$ and should have been reduced even further in view of the breathing capacity of the textile laminate. Nevertheless, the demands on the adhesion and strength of the laminate are increasing at the same time. In particular, with respect to the characteristics regarding the routine care of a textile laminate, there is the requirement that the laminate be able to survive many washings at temperatures of up to 60° C.

SUMMARY OF THE INVENTION

It is an object of the present invention to provide a fixing liner which demonstrates significantly increased adhesive and separating forces while at the same time showing very low reverse attaching tendencies.

This and other objects of the invention are achieved by a fixing liner, composed of a textile liner web (1), which is coated on one side with double-layer adhesive mass points, which are made up of lower points, facing the liner web, and upper points (2, 3), arranged above them, in which lower points (2) are made up of a powdery mixture of 25 to 90% by weight of an epoxide resin having an epoxide equivalent weight of 500 to 4000 mVal/kg and 10 to 75% by weight of an acid-terminated polyamide, a polyester, a polyurethane and/or a vinyl copolymer having carboxyl, anhydro, hydroxy, and/or amido side groups and having a melt flow index (MFI) of 40 to 120 g/10 min measured at 160° C. and 2.16 kg, 0 to 20% by weight of a hardener as well as the auxiliary and filler materials that are customarily used to produce a paste, and upper points (3) are made up of acid-terminated polyamides and/or copolyesters, the weight ratio of the masses contained in lower and upper points (2, 3) amounting to 1:0.5 to 1:5. Using the fixing liners according to the present invention, separating force values are achieved that are 50% or, especially after washing at temperatures of 60° C., more than 100% greater than those of fixing liners manufactured using the known double-layer adhesive masses.

BRIEF DESCRIPTION OF THE DRAWINGS

The present invention is discussed in greater detail with reference to the following drawings, wherein.

DETAILED DESCRIPTION OF THE INVENTION

Figure 1:
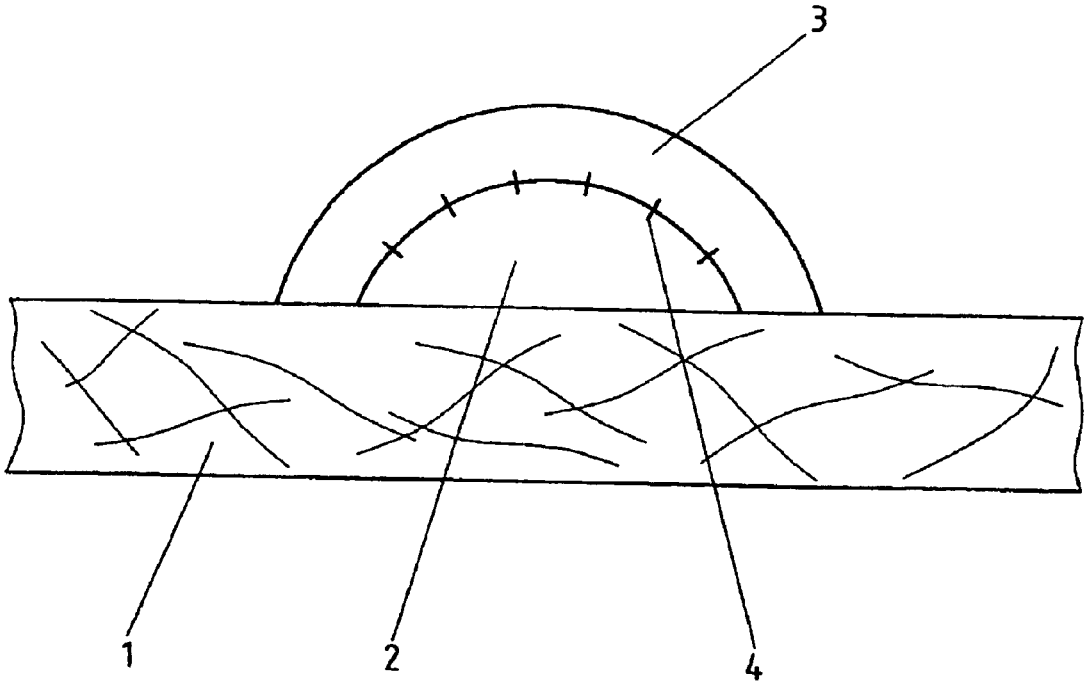
FIG. 1 depicts a fixing liner according to the present invention, in which, on a liner web (1) composed preferably of nonwoven fabrics, lower points (2) are disposed which are covered over by upper points (3) and which are cross-linked by a sintering process at temperatures of 120 to 180° C., both in themselves as well as at transition (4) to upper points (3).

At room temperature, the powdery epoxides are solid epoxide resins, which represent reaction products of epichlorohydrin having bisphenol A and/or reaction products of epichlorohydrin having bisphenol F. Furthermore, polyfunctional epoxides can be used as an epoxide resin. Examples this are epoxidized novolaks.

The polyamides, polyesters, polyurethanes and/or vinyl copolymers used having carboxyl, anhydro, hydroxy, and/or amido side groups are low-melting thermoplastic polymers. In addition, polymer blends made up of low-melting polyamides, polyesters, polyurethanes, and/or vinyl copolymers having carboxyl, anhydro, hydroxy, and/or amido side groups can be used. In this context, the polymers are constructed from linear or branched monomers. The polyamide can be generated from one or a plurality of the following monomers:

at least one at least difunctional carboxylic acid, at least one at least difunctional amine, at least one ω-amino carboxylic acid at least one lactam.

The polyester is generated from one or a plurality of the following monomers:

at least one at least difunctional carboxylic acid, at least one at least difunctional alcohol, at least one ω-hydroxy carboxylic acid, at least one lactone.

The polyurethanes can be composed of diisocyanates, polyols, and diols.

Used as hardener is the prepolymer, which is also solid at room temperature, made of epoxide resins and polyamines that are composed of reaction products of epoxide resins on the basis of bisphenol A and polyamine and/or reaction products of epoxide resins on the basis of bisphenol F and polyamine. Furthermore, a prepolymer can be used that is made of epoxide resins and polyaminoamides, composed of polyamines and dimeric fatty acids.

The fixing liner is preferably one in which the average diameter of the powdery output substances for lower points (2), as determined by the sieve analysis, is smaller than 80 μm. In this context, the fineness of the output substances aids the reactivity and the cross-linking of lower point (2), both within lower point (2) as well as at transition (4) to upper point (3).

Furthermore, the fixing liner is preferably one in which the average diameter of the powdery output substances for upper points (3), as determined by the sieve analysis, is 80 to 200 μm. The particle size according to the present invention for the upper point material aids the melting and coating of lower points (2) by upper points (3).

The fixing liner according to the present invention is obtained in that, for creating lower points (2), a paste is produced from a powdery, acid-terminated polyamide, polyester and/or polyurethane, a powdery epoxide resin, the dispersants, mobile solvents, and thickeners, and it is applied onto liner web (1) at spatially separated points; the paste, in a moist state, having 50 to 500% by weight of an acid-terminated polyamide and/or copolyester, is scattered onto the mass of lower points (2); excess scattering powder is removed; and the fixing liner obtained, having double-layer adhesive mass points, is dried at temperatures of 120 to 180° C. and, by sintering the polymer material together with the liner web, it is made manipulable and transportable.

As epoxide resins, it is possible to use EPIKOTE® of the types: 1002, 1004, 1055 from the Shell Co. or ARALDIT® of the types: GT 6097-1, GT 7072, GT 7220 from the Ciba Co. having softening points in the range of 70 to 130° C., preferably of 90 to 110° C. and epoxide equivalents of 500 to 4000 mVal/kg.

As hardeners, it is possible to use a prepolymer made of EPIKOTE®102 and diethylene triamine (1:2) and the hardener HT835 from the Ciba Co.

Examples of the acid terminated polyamides, polyesters, polyurethanes, and/or vinyl copolymers having carboxyl and anhydro side groups are: GRIFTEX®D1541 from the EMS Co. or VESTAMELT®730, VESTAMELT®840 from the DegussaHuels Co.

Example 1

In a mixing vat, a powdery mixture of 25% by weight VESTAMELT®730, 60% by weight EPIKOTE® 1055, and 15% by weight hardener HT 835 having particle sizes smaller than 80 μm is mixed into a paste in accordance with the customary method, using water and a paste base made of a dispersant, a mobile solvent, and a thickener. In a screen printing process using a CP110 pattern, the paste as lower point (2), is pressed (pressure 4 g/m$^2$) on one side onto a 25 g polyamide/polyester (PA/PES) nonwoven fabric as liner web (1), and on the still moist paste point, as upper point (3), VESTAMELT®840 P816 is scattered (7 g/m$^2$), the excess is sucked off and subsequently it is dried and sintered for 20 sec at 180° C. Total pressure 11 g/m$^2$.

The fixing liner produced in this manner was fixed against cambric.

| Fixing temperature | Primary adhesion | 60° C. washing | Reverse attaching |
|---|---|---|---|
| 120° C./12 sec | 13 N/5 cm | 11 N/5 cm | 0.3 N/10 cm |
| 140° C./12 sec | 15 n/5 cm | 14 N/5 cm | 0.3 N/10 cm |

All samples demonstrated splitting of the nonwoven fabric.

Example 2

In a mixing vat, a powder mixture of 50% by weight VESTAMELT®730, 40% by weight ARALDIT® 7220, and 10% by weight hardener HT 835 having particle sizes smaller than 80 μm is mixed into a paste in accordance with the customary method, using water and a paste base made of a dispersant, a mobile solvent, and a thickener. In a screen printing process using a CP110 pattern, the paste, as lower point (2), is pressed (pressure 6 g/m$^2$) on one side onto a 35 g PES nonwoven fabric as liner web (1), and on the still moist paste point, as upper point (3), VESTAMELT®840 P816 is scattered (8 g/m$^2$), the excess is sucked off, and subsequently it is dried and sintered for 20 sec at 180° C. Total pressure 14 g/m$^2$.

The fixing liner produced in this manner was fixed against cambric.

| Fixing temperature | Primary adhesion | 60° C. washing | Reverse attaching |
|---|---|---|---|
| 120° C./12 sec | 14 N/5 cm | 12 N/5 cm | 0 N/10 cm |
| 140° C./12 sec | 16 n/5 cm | 15 N/5 cm | 0 N/10 cm |

What is claimed is:

1. A fixing liner, comprising: a textile liner web (1), which is coated on one side with double-layer adhesive mass points, which are made up of lower points (2), facing the liner web, and upper points (3), arranged on top of the lower points (2), wherein the lower points (2) are composed of a powder mixture of greater than 25% to 90% by weight of an epoxide resin having an epoxide equivalent weight of 500 to 4000 mVal/kg, 10 to 75% by weight of an acid-terminated polyamide, a polyester, a polyurethane and/or a vinyl copolymer having carboxyl, anhydro, hydroxy, and/or amido side groups and having a melt flow index of 40 to 120 g/10 min measured at 160° C. and 2.16 kg, and 0 to 20% by weight of a hardener and filler materials used to produce a paste, and wherein the upper points (3) are composed of acid-terminated polyamides and/or copolyesters, and the weight ratio of the lower points (2) to upper points (3) is 1:0.5 to 1:5.

2. The fixing liner according to claim 1, wherein the powder mixture for the lower points (2) have an average diameter, as determined by sieve analysis, which is smaller than 80 μm.

3. The fixing liner according to claim 1, wherein the lower points (2) are composed of a powder mixture of 60% by weight of an epoxide resin having an epoxide equivalent weight of 500 to 4000 mVal/kg, 25% by weight of an acid-terminated polyamide, a polyester, a polyurethane and/or a vinyl copolymer having carboxyl, anhydro, hydroxy, and/or amido side groups and having a melt flow index of 40 to 120 g/10 min measured at 160° C. and 2.16 kg, and 15% by weight of a hardener and filler materials used to produce a paste.

4. The fixing liner according to claim 1, wherein the lower points (2) are composed of a powder mixture of 40% by weight of an epoxide resin having an epoxide equivalent weight of 500 to 4000 mVal/kg, 50% by weight of an acid-terminated polyamide, a polyester, a polyurethane and/or a vinyl copolymer having carboxyl, anhydro, hydroxy, and/or amido side groups and having a melt flow index of 40 to 120 g/10 min measured at 160° C. and 2.16 kg, and 10% by weight of a hardener and filler materials used to produce a paste.

* * * * *

UNITED STATES PATENT AND TRADEMARK OFFICE

CERTIFICATE OF CORRECTION

PATENT NO. : 6,777,065 B2
DATED : August 17, 2004
INVENTOR(S) : Grynaeus et al.

It is certified that error appears in the above-identified patent and that said Letters Patent is hereby corrected as shown below:

Column 4,
Line 58, after Claim 2, insert:
-- 3. The fixing liner according to Claim 1, wherein the upper points (3) further comprise a powder mixture having an average diameter, as determined by sieve analysis, of from 80 to 200 $\mu$m. --.

Signed and Sealed this

Sixteenth Day of August, 2005

JON W. DUDAS
*Director of the United States Patent and Trademark Office*